United States Patent [19]

Kantwerk

[11] Patent Number: 4,485,507

[45] Date of Patent: Dec. 4, 1984

[54] COMBINATION SCISSOR HAMMER TOOL

[76] Inventor: Karl-Heinz Kantwerk, Krebsmuehlenring 92, 8631 Ahorn-Schorkendorf, Fed. Rep. of Germany

[21] Appl. No.: 519,604

[22] Filed: Aug. 2, 1983

[30] Foreign Application Priority Data

Jul. 15, 1983 [DE] Fed. Rep. of Germany ..... 3325602

[51] Int. Cl.[3] ..... B26B 13/22

[52] U.S. Cl. ..... 7/135; 7/144

[58] Field of Search ..... 7/135, 134, 132, 143, 7/144; 30/134; D8/57

[56] References Cited

U.S. PATENT DOCUMENTS

| | | | |
|---|---|---|---|
| D. 57,097 | 2/1921 | Zylka | 7/135 |
| 183,404 | 10/1876 | Locke | 30/134 |
| 389,553 | 9/1888 | Diefendorf | 7/135 |
| 553,579 | 1/1896 | Frye | 7/135 |
| 1,188,836 | 6/1916 | Robinson | 30/134 |
| 4,037,276 | 7/1977 | Brinker | 7/135 |

FOREIGN PATENT DOCUMENTS

| | | | |
|---|---|---|---|
| 2249577 | 10/1972 | Fed. Rep. of Germany | D8/57 |

*Primary Examiner*—Roscoe V. Parker

*Attorney, Agent, or Firm*—Jordan & Hamburg

[57] ABSTRACT

A combination tool in the form of scissors with two double levers connected to one another in an articulated fashion has cooperating cutting edges on one side of the lever arm and handles on the other, with the lever arms carrying the handles being formed in a hammer head fashion and the lever arms carrying the opposed cutting edges having a longitudinal opening to receive the lever arm carrying the cutting edge and with both lever arms having a closed cross-section in the closed position.

14 Claims, 7 Drawing Figures

COMBINATION SCISSOR HAMMER TOOL

BACKGROUND OF THE INVENTION

The invention relates to a combination tool in the form of scissors with two double levers connected to one another in an articulated fashion and having on one portion cooperating cutting edges and on the other portion the handles.

Tools are frequently designed in such a way that they can serve several purposes, for example, a combination pliers which can be used as tweezers and pliers at the same time. With the help of these tools, there is no need for the users to keep a whole supply of special tools. This is true for work shops as well as home use and also for the use of tool sets in automobiles.

Each year the accident statistics show an alarmingly high number of traffic victims and experts in analyzing accidents repeatedly point to the fact that many human lives could have been saved had emergency aid been given sooner. However, emergency aid is only possible when the injured person is outside his or her vehicle. Following an accident, with the passengers being trapped in their vehicles, they first of all have to be freed. Generally, there is no suitable tool for freeing them at the scene of the accident which would assure speedy and effective action.

With the present invention, this frequent problem concerning prompt emergency aid can be eliminated and, at the same time, the general need for a multiple purpose tool satisfied.

In order to solve the problem at hand, the invention provides a tool of the initially mentioned type in which the lever arms carrying the handles are formed together in a hammer head fashion and in which the lever arm carrying the opposed cutting edge has a longitudinal opening to receive the lever arm with the cutting edge and in which the lever arms have a closed rod cross-section when in a closed position. Thus, the same tool can be used as a scissors as well has a hammer. When used as a hammer, the lever arms carrying the cutting edge or the opposed cutting edges serve together as a hammer handle in the closed position of the combination tool, assuring secure and convenient handling. With the help of such a combination tool, the back, front and side windows in a vehicle can be broken without too much effort, for example, in the case of an accident and by an untrained person as well. Thus, a very important prerequisite is provided in that the persons who first arrive at the scene of an accident will have access to the inside of the vehicle. On the other hand, a person can also possibly free himself from a wrecked car. However, the combination tool is as efficiently used as scissors, for example, to rapidly cut off the seat belt by which a passenger might still be entrapped. This is particularly important in those instances when the passenger cannot reach the lock of the belt or the lock is jammed.

Based on these general basic concepts of the invention, it further provides for the hammer head, consisting of the handles, to have on the side of the one lever arm a pointed and on the side of the other lever arm a rounded outer profile. The design of the hammer head assures that the combination tool has great flexibility and that it can be used in an optimal fashion. It is therefore possible to easily break the window of a vehicle by first making a hole in the window with the pointed outer profile of the hammer head and then breaking it out with the rounded outer profile of the hammer head.

In an additional embodiment of the invention, the lever arm forming the hammer head is flattened laterally, perpendicular to the articulated axis of the double lever. The flattened hammer head is easier to handle, compared to conventional hammers, when the combination tool is to be used as a lever, for example, to pry open jammed doors. Depending on the situation at hand, the hammer handle can be used as a lever in order to first widen a door slit a bit and then to finally open the door completely.

It has been shown to be particularly advantageous that the lever arms forming the handle have material thickenings, increasing the volume. Through this increase of the specific weight of the hammer head, the effectiveness of the combination tool as a hammer is markedly improved. With little effort, a relatively good effect can be achieved which is of particular importance since those persons using the combination tool under such circumstances might be in shock or even injured themselves.

The invention further provides for the lever arm forming one of the handles to have an approximately circular opening for the thumb and for the other to have a longitudinal opening for the other fingers of the hand. In this embodiment of the combination tool according to the invention a compromise has to be found between two equally justifiable demands on the tool. On the one hand, it has to be convenient to use as scissors and by a corresponding design of the opening, assure an optimal power transmission from the hand of the user to the cutting edges of the scissors. This is particularly important, since the seat belt which might still be strapped around the passenger and which is made of a very strong material will have to be cut very quickly in the case of an accident. On the other hand, the openings for the fingers should not be too large, unduly reducing the volume of the hammer head and causing the tool to lose some of its effectiveness when being used as a hammer.

In a further embodiment of the invention, the lever arm carrying the opposed cutting edge can be approximately U-shaped in cross-section with the one U-shaped handle portion being shorter than the other, and with the cutting edge of the other lever arm engaging into the interspace between the two U-shaped handle portions with the front end of the shorter U-shaped portion serving as contact point for a cross-bar of the other lever arm, the cross-bar running next to the cutting edge. In this way, the cutting edges of the scissors result in a massive profile for the hammer handle, assuring an effective power transmission when the combination tool is being used as a hammer. By means of the contact points of the cutting edges these firmly support one another. This is particularly important with respect to the required handiness and optimal power transmission of the tool of the invention.

In an additional embodiment of the invention, the lever arms carrying the cutting edges have a circular to oval cross-section and the lever arm carrying the cutting edges occupies approximately one-fourth of this cross-section, the cutting edge being approximately triangular in cross-section and disposed in the cross-section. The lever arms can, of course, also have a polygonal cross-sectional area. It has to be assured that the combination tool in the invention is convenient to use whether as a hammer or as a scissors.

Additional characteristics, details and advantages of the invention can be seen from the following description of an embodiment of the invention as well as from the drawings.

FIF. 2 shows the tool with the parts disassembled.

Figures 1, 3, 4:
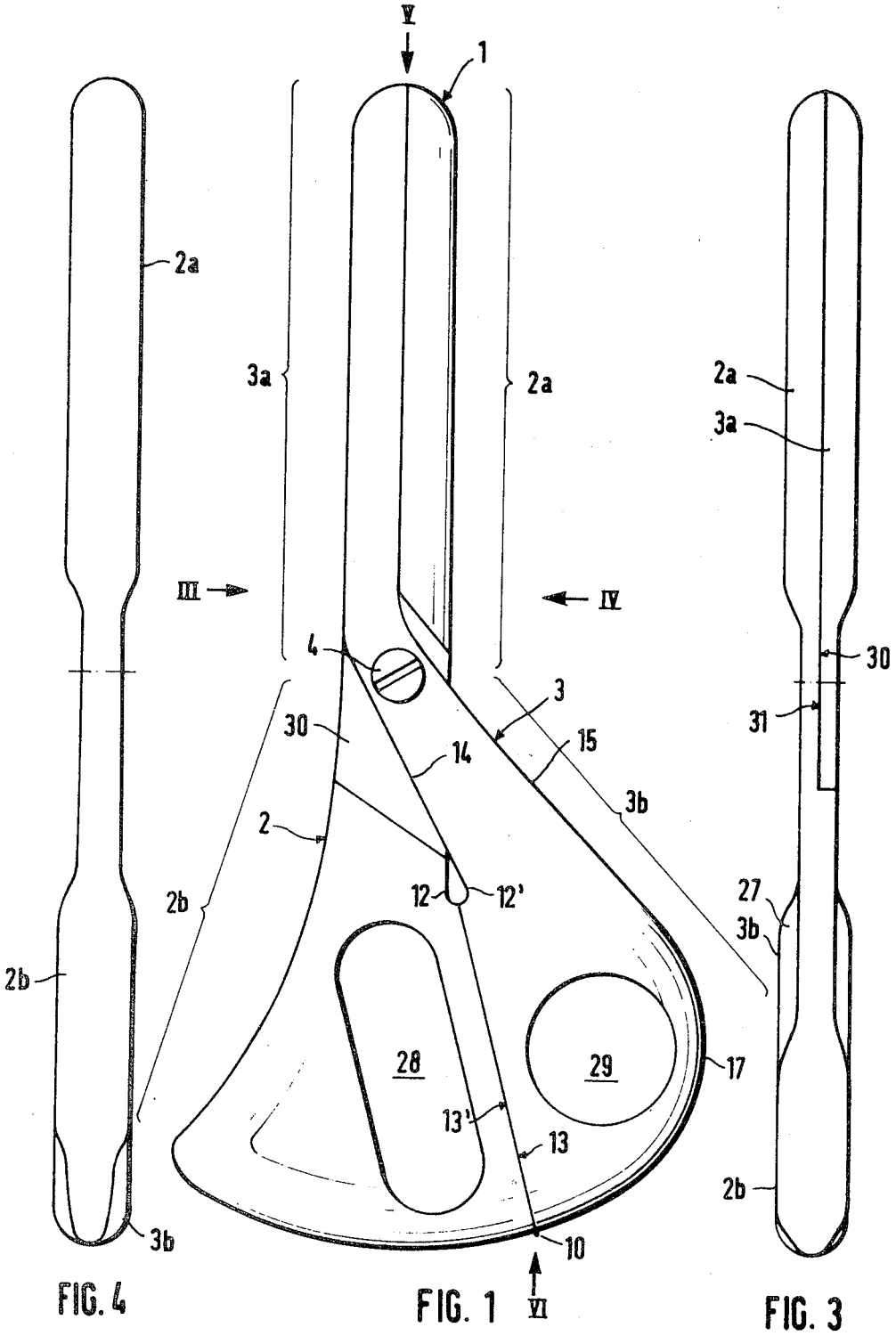
FIG. 1 is a plan view of the combination tool.

FIG. 3 is a side view of the tool looking in the direction of the arrow III in FIG. 1.

FIG. 4 is a side view of the tool looking in the direction of the arrow IV in FIG. 1.

Figure 5:
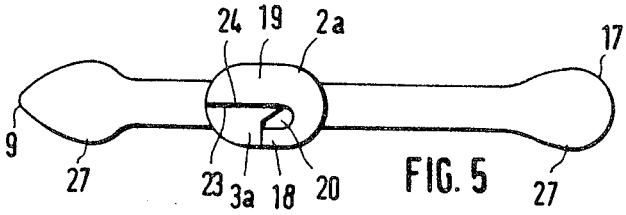

FIG. 5 is a top view looking in the direction of the arrow V in FIG. 1.

Figure 6:
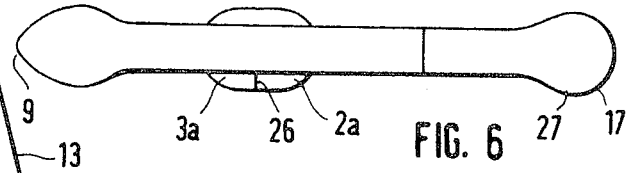

FIG. 6 is a bottom view looking in the direction of the arrow VI in FIG. 1, and

Figure 7:
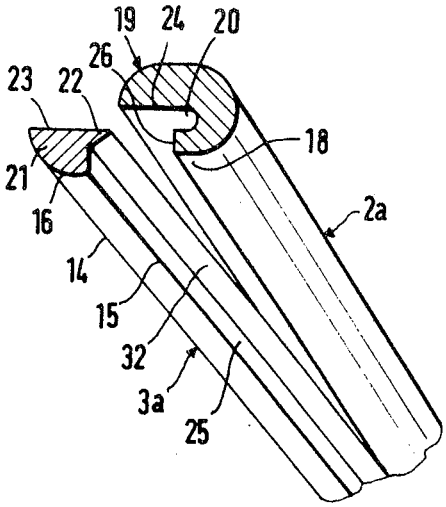

FIG. 7 is an interrupted perspective view of the lever arms carrying the cutting edges.

DESCRIPTION OF THE PREFERRED EMBODIMENTS

Combination tool 1 consists of two double levers 2 and 3 which are preferably connected to one another by a screw or pin connection 4 in an articulated fashion.

Figure 2:
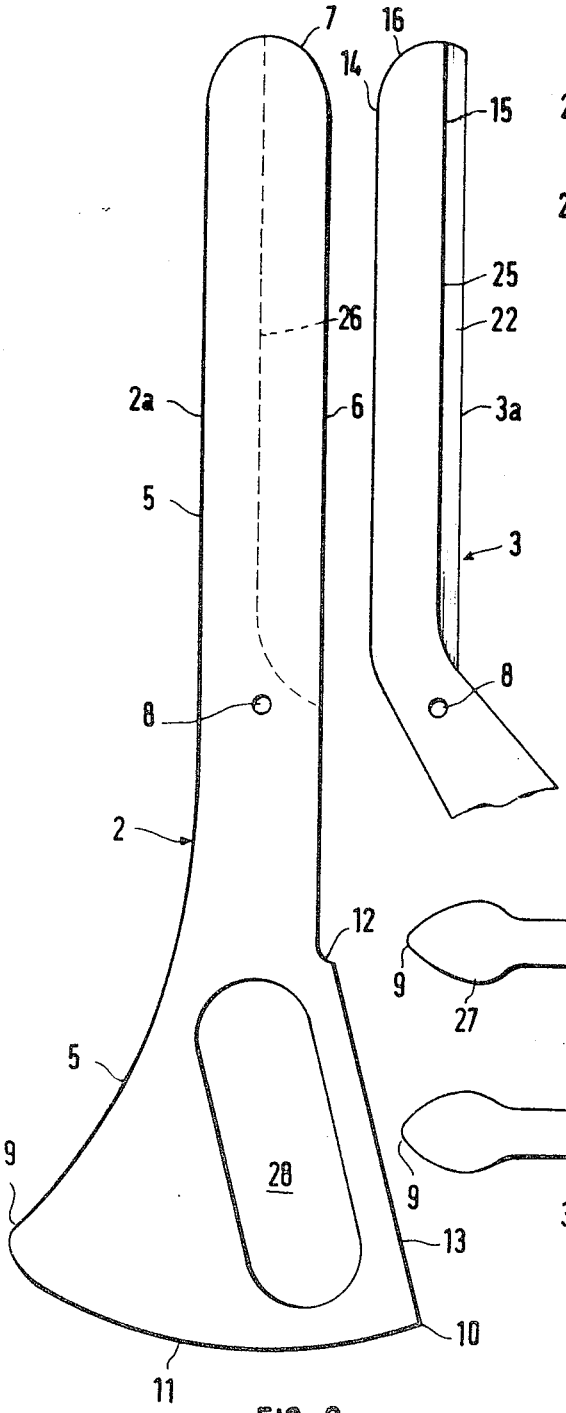

As can be clearly seen from FIG. 2, double lever 2 has two parallel outer edges in the upper half, as seen from the standpoint of the viewer, connected to one another by a semi-circular end 7. The outer edge 5 curves externally below a bore 8 of the articulated connection 4 in a circular arc until reaching point 9. The outer edge 6 continues to run straight over a somewhat longer length than the outer edge 5 and continues, having made a narrow circle 12 at 20° to 30°, along a straight edge course 13 until reaching point 10. Points 9 and 10 are connected with an arc 11.

Double lever 3 has two parallel outer edges 14 and 15 as well, which, in this embodiment are connected to an arc 16 at their upper end, the arc being approximately 90°. At about the height of bore 8 of screw connection 4, both outer edges 14 and 15 extend externally at an angle of approximately 45°. In their continued course (FIG. 1), the distance of the outer edges 14 and 15 increases with the outer edge 15 becoming a circular arc 17. The outer edge 14 also includes a circular arc 12', which is, however, facing the opposite way, at a height corresponding to the circular arc 12 of the outer edge 6 and which continues into edge 13' of the double lever 3 corresponding with the edge 13 of the double lever 2.

Seen in cross-section (FIG. 7), the lever arm 2a of the double lever 2 is approximately U-shaped in the area of its parallel outer edges 5 and 6 with one leg being shorter than handle 19. Lever arm 3a of the double lever 3, shown in cross-section (FIGS. 5 and 7) corresponds to approximately one-fourth of an oval 21 with a triangular appendix 22. The inner edge of lever arm 3a is a cutting edge 23. The interior side of the longer U-shaped handle 19 of lever arm 2a is the corresponding opposing cutting edge 24. The triangular appendix 22 of lever arm 3a which forms the cutting edge 23 protrudes into the interspace 20 formed by U-shaped portion 18 and 19 of lever arm 2a. A contact area 25 runs along lever arm 3a on the outside of the oblique area 32. When the scissors are closed, area 25 of the lever arm 3a contacts the front face 26 of the shorter U-shaped handle 18 of the lever arm 2a. In this closed position, the lever arms 2a and 3a carrying the cutting edges 23 and 24 have an oval, closed cross-sectional configuration in the illustrated embodiment.

In their assembled state, the two double levers 2 and 3 pivot around the common articulated axis 4. In order to enable the pivoting movement, areas 30 and 31 of double levers 2 and 3 which slide on top of one another are flattened out perpendicular to the articulated axis 4 of the double lever (compare FIGS. 3 and 4).

The lever arms 2b and 3b, which together form the handle of the tool, are formed as a hammer head (FIG. 1) and have a bulbous thickening 27 along their outer edges 5, 11, and 17, 15 (FIGS. 5 and 6). A circular opening 29 is located in the area of the lever arm 3b for the thumb, and a longitudinal hole 28 in the area of the lever arm 2b for the other fingers of the hand.

The combination tool can, for example, be made of steel, which is surface hardened and tenacious in the core and should preferably be coated, at least partially, by a synthetic coating or lacquer. If used as a hammer, lever arms 2a and 3b, which carry the cutting edges together serve as a hammer handle in their closed position (see FIG. 1), and lever arms 2b and 3b together serve as a hammer head which, on the one side, has a pointed profile and on the opposite side a rounded profile. When using the combination tool as a scissors, the hammer head serves as the scissor handle. In order to make sure that the combination tool is ready to be conveniently used whenever needed, it is advisable to attach it by a clamping closure in the front part of the passenger compartment to the instrument panel or to the console.

I claim:

1. A combination tool comprising two pivotally connected levers pivoted between an open position and a closed position, each of said levers having a first section cooperable with one another to form a scissors, one of said first sections having a cutting edge and the other of said first sections having a longitudinal opening to receive said cutting edge, said other first section having a generally U-shaped cross-sectional configuration defined by two inner leg-walls, one of said leg-walls being longer than the other leg-wall, said shorter leg-wall having a terminating end wall, said one first section having a first, second, and third wall portion, said first wall portion being slidably cooperable with said one leg-wall to effect a scissor-like action when said two levers are pivoted between said open and closed positions, said second wall portion being disposed within the U between said two leg-walls when said two levers are in said closed position, said third wall portion engaging said terminating end wall when said two levers are in said closed position, whereby when said two levers are in said closed position, said two levers together cooperate to define a longitudinal extending outer uninterrupted smooth surface functional as a hammer handle, each of said levers having a second section defining scissor handles adapted to be manually engaged to pivot said two levers between said open and closed position, said second sections defining a hammer head, said hammer handle being adapted to be manually grasped to use said combination tool has a hammer when said two levers are in said closed position.

2. A combination tool according to claim 1, wherein said terminating end wall is substantially perpendicular to said shorter leg-wall.

3. A combination tool according to claim 1, wherein said first and second wall portions are disposed at an acute angle relative to one another, and said second and third wall portions are disposed at an obtuse angle relative to one another.

4. A combination tool according to claim 2, wherein said terminating end wall and said third wall portion are parallel to one another when said two levers are in said closed position.

5. A combination tool according to claim 1, wherein one of said second sections has an outer portion defining a first hammer head section and the other of said second sections has an outer portion defining a second hammer head section, said first hammer head section having an outer configuration different from the configuration of said second hammer head section.

6. A combination tool according to claim 1, wherein said first hammer head section has a generally pointed outer configuration and said second hammer head section has a generally rounded outer configuration.

7. A combination tool according to claim 5, wherein said first hammer head section projects generally along a hammer-head axis extending laterally of the longitudinal axis of said one lever, and said second hammer-head section projections generally along a hammer-head axis extending laterally of the longitudinal axis of said other lever, each of said hammer-head axes being disposed generally perpendicularly relative to the pivotal axis of said two levers.

8. A combination tool comprising two pivotally connected levers pivoted between an open position and a closed position, each of said levers having a first section cooperable with one another to form a scissors, one of said first sections having a cutting edge and the other of said first sections having a longitudinal opening of a generally U-shaped cross-sectional configuration to receive said cutting edge, each of said levers having a second section defining scissor handles adapted to be manually engaged to pivot said two levers between said open and closed positions, said second sections defining a hammer head, said first sections being constructed to have a generally rounded outer configuration such that when said two levers are in said closed positions, said two levers together mate and cooperate to define an outer longitudinally extending and uninterrupted smooth rounded surface functioning as a hammer handle, said hammer handle being adapted to be manually grasped to use said combination tool as a hammer when said two levers are in said closed position.

9. A combination tool according to claim 8, wherein said one first section has an outer rounded surface representing approximately one-quarter of the outer circumferential surface of said hammer handle and said other first section has an outer rounded surface representing approximately three-quarters of the outer circumferential surface of said hammer handle.

10. A combination tool according to claim 8, wherein said hammer handle has an outer uninterrupted oval cross-sectional configuration.

11. A combination tool according to claim 8, wherein said hammer handle has an outer uninterrupted elliptical cross-sectional configuration.

12. A combination tool according to claim 8, wherein each of said two levers have sections at the longitudinal ends thereof which are thicker than an intermediate thinner central section, said thickness being in a direction parallel to the pivotal axis of said two levers.

13. A combination tool according to claim 8, wherein each of said second sections has an opening for receiving a person's finger for using the combination tool as a scissors.

14. A combination tool according to claim 13, wherein the opening in one of said second sections is circular for receiving a thumb and the opening in the other of said second sections is elongated to receive a plurality of fingers.

* * * * *